United States Patent [19]

Prioux et al.

[11] Patent Number: 4,499,343

[45] Date of Patent: Feb. 12, 1985

[54] MONOLITHIC FLAT TACTILE KEYBOARD

[75] Inventors: Jean-Jacques Prioux, Chateau Gontier; Roger Meleard, Beynes; Michel Pioger, Laval; Jean-Jacques Lasvaladas, Chateau Gontier, all of France

[73] Assignee: Rogers Corporation, Rogers, Conn.

[21] Appl. No.: 474,020

[22] Filed: Mar. 10, 1983

[30] Foreign Application Priority Data

Mar. 11, 1982 [FR] France ..... 82 04095

[51] Int. Cl.[3] ..... H01H 13/70

[52] U.S. Cl. ..... 200/5 A

[58] Field of Search ..... 200/5 A, 159 B, 275, 200/30 C

[56] References Cited

U.S. PATENT DOCUMENTS

| | | | |
|---|---|---|---|
| 4,046,975 | 9/1977 | Seeger, Jr. | 200/5 A |
| 4,066,850 | 1/1978 | Heys, Jr. | 200/5 A |
| 4,066,851 | 1/1978 | White et al. | 200/5 A |
| 4,237,351 | 12/1980 | Boulanger | 200/5 A |
| 4,245,138 | 1/1981 | Harper | 200/159 B |
| 4,314,116 | 2/1982 | Gordon | 200/5 A |
| 4,323,740 | 4/1982 | Balash | 200/5 A |
| 4,365,130 | 12/1982 | Christensen | 200/5 A X |
| 4,375,018 | 2/1983 | Petersen | 200/5 A |

*Primary Examiner*—J. R. Scott

*Attorney, Agent, or Firm*—Fishman & Dionne

[57] ABSTRACT

A tactile keyboard assembly of the membrane type has a unitary front face member which bears the keyboard graphics and has generally convex protrusions in the key areas. The front face is spaced from a sheet which defines an array of snap-action actuators which support movable switch contacts, the actuators comprising dome-shaped members formed in a carrier sheet which, when depressed, will provide tactile feedback. The key areas are in registration with the actuators.

8 Claims, 3 Drawing Figures

MONOLITHIC FLAT TACTILE KEYBOARD

BACKGROUND OF THE INVENTION (1) Field of the Invention

The present invention relates to switch arrays and particularly to membrane type keyboards which comprise a switch array. More specifically, this invention is directed to a flat membrane keyboard having a front face with raised key areas and underlying switches which, when actuated, provide tactile feedback to the user. Accordingly, the general objects of the present invention are to provide novel and improved apparatus of such character.

(2) Description of the Prior Art

Recent advances in the field of microelectronics have resulted in a demand for miniaturized keyboards for use in the inputting of data to appliances such as calculators and electronic games. In order to be suitable for widespread use in appliances which include microprocessors, a keyboard must possess certain attributes. These attributes include a high degree of reliability, small size, low cost, uncomplicated construction, ease of key location by the user and the ability to provide the user with tactile feedback which will indicate that the switch contacts associated with an operated key have been closed. While these attributes have been individually achieved in the prior art, there has not previously been a keyboard possessing all of these attributes.

There are, in the prior art, many types of keyboards. The known keyboards include those relatively complex devices having separate actuating key arrangements for the switch array and flat multi-layer devices of the type generally known in the art as "membrane" keyboards. For a general discussion of membrane type keyboards which provide the user with tactile feedback, reference may be had to U.S. Pat. No. 4,245,138. A membrane type keyboard with tactile feedback which includes raised key portions is disclosed in U.S. Pat. No. 4,190,748.

While the keyboards of the referenced patents, and other similar keyboard arrangements, have proven to be exceptionally successful, there has not previously been available a keyboard which incorporates tactility with a convex formed graphic front face so that the separate mechanical keys and elaborate housings required with previous tactile keyboards having raised key locators on the surface were not necessary.

SUMMARY OF THE INVENTION

The present invention overcomes the above-discussed and other deficiencies of the prior art by providing a membrane keyboard assembly wherein each key includes a snap-action tactile actuator which is in registration with a key locating protrusion formed on a graphics bearing front face. Depression of the key locating protrusions on the front face will establish contact with the associated actuator to thereby cause the actuator to snap-through center or invert to establish electrical contact between movable and stationary switch contacts while simultaneously providing tactile feedback to the user.

A keyboard in accordance with the present invention is of multi-layer construction with the switch contacts and conductors of a switch array being defined by printed circuit techniques on a substrate. The substrate which bears the movable switch contacts is shaped, in the contact areas, to have actuator protrusions which are configured to invert through the plane of the substrate when a force is applied. The substrate or substrates bearing the movable and stationary switch contacts are separated by an apertured spacer layer of non-conductive material. A second apertured spacer is provided on the side of the movable switch contact supporting substrate which faces away from the stationary switch contacts, the actuator protrusions being located in apertures in the second spacer. A front face sheet, also comprised of a flexible plastic material, overlies the second spacer and is provided with convex portions which are in registration with the switch actuators. These convex portions bear indicia commensurate with the individual key functions. The front face, spacers and switch contact bearing substrates are adhesively bonded to one another to define a very thin keyboard structure. If necessary or desirable, a rigid backing member may be applied behind the substrate which bears the stationary switch contacts.

BRIEF DESCRIPTION OF THE DRAWING

The present invention may be better understood and its numerous objects and advantages will become apparent to those skilled in the art by reference to the accompanying drawing wherein like reference numerals refer to like elements in the several FIGURES and in which.

DESCRIPTION OF THE PREFERRED EMBODIMENT

Figure 1:
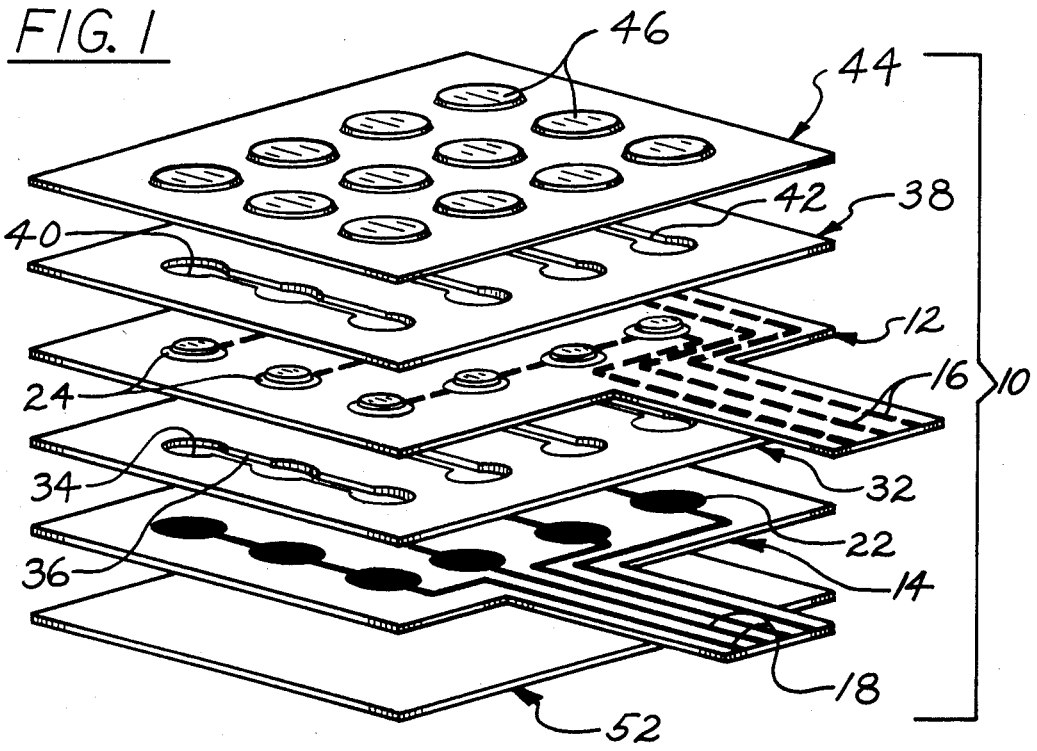
FIG. 1 is an exploded perspective view of a keyboard assembly in accordance with a preferred embodiment of the present invention.

With reference to the drawing, a keyboard assembly in accordance with the present invention is indicated generally at 10. The keyboard assembly 10 will comprise a switch array defined by a plurality of pairs of cooperating stationary and movable switch contacts and by conductors which interconnect the switch contacts. The conductors of the switch array may be connected to circuitry which, by scanning rows and columns, senses the condition of the individual keyboard switches. The switch contacts and interconnecting conductors are formed on a pair of substrates which have been indicated generally at 12 and 14. Substrates 12 and 14 will be comprised of a suitable non-conductive plastic material and, in the case of at least substrate 12, this plastic material will be flexible so as to permit the formation of the snap-through protrusions which define the switch actuators therein. It is to be noted that, in the interest of manufacturing economy, the substrates 12 and 14 may be comprised of a single sheet which, after the circuit patterns have been formed thereon, is folded around a spacer layer.

Figure 2:
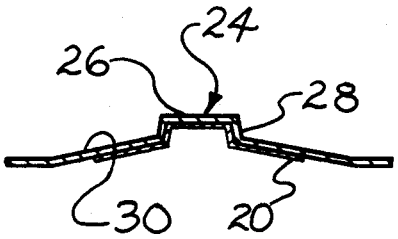
FIG. 2 is a schematic side elevation view, on an enlarged scale, of a tactile actuator which comprises a movable switch contact in the keyboard of FIG. 1.

The upper substrate 12 supports, on the lower side thereof, i.e., the side which faces substrate 14, a conductive pattern 16 which comprises a plurality of conductors and switch contacts 20. The switch contacts 20 are on the underside of protrusions 24, formed in substrate 12, which may best be seen from FIG. 2. The protrusions 24 are sized and shaped in accordance with techniques well known in the art such that, upon application of force to a flat circular top surface 26 thereof, the protrusion will snap-through the plane of the substrate. The protrusions 24, in addition to the flat circular tops 26, comprise side wall portions 28 which, in effect, define a generally cylindrical actuating protrusion on the top of a generally frustroconical shaped dome having slightly arcuate side walls 30.

The lower substrate 14 will also support a conductive pattern 18, pattern 18 being on the side of substrate 14 which faces the conductive pattern on substrate 12. The conductive pattern 18 on substrate 14 will include stationary switch contacts 22 which are in registration with the movable switch contacts 20 on the underside of the protrusions formed in substrate 12. Substrate 14 will typically be flat, i.e., the stationary switch contacts 22 will not be supported on protrusions.

An apertured spacer, indicated generally at 32, is positioned between substrates 12 and 14 as shown. Spacer 32 will be comprised of a suitable non-conductive plastic material. The apertures 34 in spacer sheet 32 will be in registration with the switch contacts on substrates 12 and 14. In a preferred embodiment groups of the apertures 34 will be interconnected by channels 36 which extend completely through the spacer sheet.

A second apertured non-conductive spacer sheet (optional), indicated generally at 38, will overlay the substrate 12. The spacer sheet 38 will be provided with apertures 40 which receive the protrusions 24 and, as in the case of spacer sheet 32, groups of the apertures 40 may be interconnected by means of channels 42.

Figure 3:
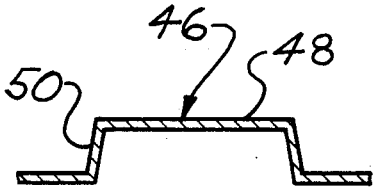
FIG. 3 is a schematic side elevation view, on an enlarged scale, of a raised key locator region on the front face of the keyboard of FIG. 1.

A graphic front face sheet, indicated generally at 44, will be positioned over spacer 38. Front face sheet 44 will be comprised of a flexible, non-conductive material and will be provided with a plurality of round-topped protrusions 46. The shape of the protrusions 46 in accordance with a preferred embodiment may be seen from FIG. 3. Thus, the protrusions have a flat top surface 48 and slightly converging side walls 50, the side walls and tops thus defining generally convex regions on the front face of the keyboard assembly. The protrusions 46 will be in registration with the apertures 40 in spacer 38. The front face sheet 44 will, in the regions of the protrusions 46 be imprinted in any suitable manner such that the protrusions bear indicia indicative of the function of the underlying switch of the keyboard switch array. Thus, sheet 44 will function as a decorative front face with formed key touches.

If deemed necessary or desirable, the keyboard assembly of the present invention may also be provided with a backer plate 52, typically comprised of a suitable non-conductive material, which will rigidize the entire assembly.

The front face 44, spacers 32 and 38, substrates 12 and 14 and backing board 52, when present, will be laminated together with a suitable adhesive to define a flat, membrane-type keyboard of very thin construction.

Because of the raised protrusions 46, a user may easily and rapidly locate the various key regions of the keyboard, i.e., the protrusions 46 function as key locators which, as noted, also bear graphic material indicating the key function. The application of downward pressure to a protrusion 46 will, because of the flexibility of the material from which front face 44 is formed, result in the underside of the protrusion 46 contacting the top surface 26 of a switch actuator. Continued downward force will result in the inversion of the wall 30 of the protrusion 24 to thus establish, through the aperture in spacer sheet 32, electrical contact between the stationary and movable switch contacts 20 and 22. Upon removal of pressure from the protrusion 46, because of the natural resiliency of the material from which the front face 44 and substrate 12 are constructed, the elements will return to their original unactuated position with the movable and stationary switch contacts spaced by the spacer sheet 32.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. A keyboard assembly comprising:

means defining an array of switches, said switch array defining means including a plurality of spacially displaced convex hollow switch actuators extending upwardly from a first planar side thereof, said actuators being integral with a flexible plastic circuit bearing substrate and each having a top surface, said actuators each supporting a movable switch contact on the side thereof which faces generally oppositely to said first side, at least a portion of said actuators rapidly changing in shape upon application of force to the top surface thereof to provide tactile feedback indicative of the motion of the movable switch contact;

a front face sheet, said face sheet being comprised of a flexible plastic material and having formed therein integral convex key locators, said key locators comprising spaced hollow protrusions which have a circular cross-section, said key locators extending upwardly away from said switch array first side and being in registration with said switch actuators, the top outwardly faceing surfaces of each of said key locators bearing indicia commensurate with the function of the switch of the switch array which is in registration therewith;

said movable switch contacts projecting into and being received by said spaced hollow protrusions; and first spacer means, said spacer means being comprised of a plastic material and being positioned between and laminated to said switch array means first side and said front face sheet, said spacer means being provided with apertures which are in alignment with said registered switch actuators and key locators whereby the application of force to said key locators will cause deflection thereof in the direction of the associated switch actuator to thereby transfer the force to the switch actuator.

2. The keyboard assembly of claim 1 wherein said key locators are of frustroconical shape and have substantially flat top surfaces.

3. The keyboard assembly of claim 2 wherein said switch array defining means switch actuators each have a generally frustroconical portion extending from a plane defined by the substrate and a generally cylindrical top portion surmounting the smaller diameter end of the frustroconical portion and being coaxial therewith.

4. The keyboard assembly of claim 3 wherein said switch array defining means further comprises:

a second plastic circuit bearing substrate, the stationary contacts of the switches of said switch array being supported on said second substrate in registration with tne movable switch contacts; and second spacer means, said second spacer means being comprised of a non-conductive plastic material and being positioned between and laminated to the facing circuit bearing surfaces of said substrates, said second spacer means being provided with apertures which are in alignment with said registered movable and stationary switch contacts.

5. The keyboard assembly of claim 4 wherein:

said movable switch contacts project into and are received by said apertures of said second spacer means.

6. The keyboard assembly of claim 1 wherein:

said apertures of said first spacer means are interconnected.

7. The keyboard assembly of claim 4 wherein:

said apertures of said second spacer means are interconected.

8. The keyboard assembly of claim 7 wherein:

said apertures of said first spacer means are interconnected.

* * * * *